US007454347B2

(12) United States Patent
Koyama

(10) Patent No.: US 7,454,347 B2
(45) Date of Patent: Nov. 18, 2008

(54) VOICE LABELING ERROR DETECTING SYSTEM, VOICE LABELING ERROR DETECTING METHOD AND PROGRAM

(75) Inventor: Rika Koyama, Kobe (JP)

(73) Assignee: Kabushiki Kaisha Kenwood, Tokyo (JP)

( * ) Notice: Subject to any disclaimer, the term of this patent is extended or adjusted under 35 U.S.C. 154(b) by 772 days.

(21) Appl. No.: 10/920,454

(22) Filed: Aug. 18, 2004

(65) Prior Publication Data

US 2005/0060144 A1 Mar. 17, 2005

(30) Foreign Application Priority Data

Aug. 27, 2003 (JP) ..... 2003-302646

(51) Int. Cl.
*G10L 13/00* (2006.01)
*G10L 13/06* (2006.01)
*G10L 13/02* (2006.01)

(52) U.S. Cl. ..... 704/268; 704/258; 704/260

(58) Field of Classification Search ..... 704/254, 704/258, 260, 262–264, 268
See application file for complete search history.

(56) References Cited

U.S. PATENT DOCUMENTS 5,390,278 A * 2/1995 Gupta et al. ..... 704/243
5,796,916 A * 8/1998 Meredith ..... 704/258
6,212,501 B1 * 4/2001 Kaseno ..... 704/258
6,411,932 B1 * 6/2002 Molnar et al. ..... 704/260
6,594,631 B1 * 7/2003 Cho et al. ..... 704/268
6,665,641 B1 * 12/2003 Coorman et al. ..... 704/260
7,266,497 B2 * 9/2007 Conkie et al. ..... 704/258
2003/0177005 A1 * 9/2003 Masai et al. ..... 704/220
2005/0027531 A1 * 2/2005 Gleason et al. ..... 704/260

FOREIGN PATENT DOCUMENTS

JP 06-266389 9/1994

OTHER PUBLICATIONS

Hunt, "A robust formant-based speech spectrum comparison measure," In Proceedings of the IEEE International Conference on Acoustics and Speech Signal Processing, 1985, pp. 1117-1120.*
Zue et al, "Acoustic Segmentation and Phonetic Classification in the SUMMIT system," Proc. ICASSP-89, May 1989, pp. 389-392.*

(Continued)

*Primary Examiner*—James S Wozniak
(74) *Attorney, Agent, or Firm*—Eric J. Robinson; Robinson Intellectual Property Law Office, P.C.

(57) ABSTRACT

A labeling part 3 analyzes the character string data to produce a phoneme label and a prosody label, partition the voice data stored in a voice database 1 into phonemic data, and label the phonemic data, employing the phoneme label and the like. A phoneme segmenting part 4 connects the voice data labeled with the same kind of phonemic data, and a formant extracting part 5 specifies the frequency of formant of each piece of phonemic data. A processing part 6 decides an evaluation value for each phonemic data based on the frequency of formant, and an error detection part 7 detects the phonemic data of which a deviation of the evaluation value within a set of phonemic data reaches a predetermined amount.

7 Claims, 4 Drawing Sheets

OTHER PUBLICATIONS

European Search Report dated Dec. 15, 2004 for EP 04 020 133.

S. Nakajima et al., *Automatic Generation of Synthesis Units Based on Context Oriented Clustering*, ICASSP 88: 1988 International Conference on Acoustics, Speech, and Signal Processing (CAT. No. 88CH2561-9), Apr. 11, 1988, pp. 659-662.

A. Black et al., *Automatically Clustering Similar Units for Unit Selection in Speech Synthesis*, 5th European Conference on Speech Communication and Technology, Eurospeech '97, Rhodes, Greece, Sep. 22-25, 1997, European Conference on Speech Communication and Technology, Grenoble: ESCA, FR, vol. 2 of 5, pp. 601-604, Sep. 22, 1997.

A. Acero, *Formant Analysis and Synthesis Using Hidden Markov Models*, Proceedings of International Conference on Acoustics, Speech, and Signal Processing (ICASSP '03), Apr. 6-10, 2003, Honkong, vol. 3, pp. 1047-1050, Apr. 6, 2003.

* cited by examiner

VOICE LABELING ERROR DETECTING SYSTEM, VOICE LABELING ERROR DETECTING METHOD AND PROGRAM

This application claims priority from Japanese Patent Application No.2003-302646 filed Aug. 27, 2003, which is hereby incorporated by reference.

BACKGROUND OF THE INVENTION

1. Field of the Invention

The present invention relates to a voice labeling error detecting system, a voice labeling error detecting method and a program.

2. Related Background Art

In recent years, the technique of speech synthesis has been widely employed to synthesize the voice. More specifically, there are a number of scenes of using the voice such as a text reading software, the directory inquiry, stock information, travel guide, shop guide, and traffic information, for example.

The speech synthesis methods are largely classified into a rule base method and a waveform editing method (corpus base method).

The rule base method is a method for producing a voice by making morphological analysis for a text to synthesize a speech, and phonetic processing for the text, based on the analysis result. In the rule base method, there is a small restriction on the contents of text used for speech synthesis, whereby the text having various contents can be employed for speech synthesis. However, the rule base method is inferior in the quality of voice to the corpus base method.

On the other hand, in the corpus base method, the actual sounds of a human voice are recorded, a waveform of the recorded sounds is partitioned to prepare a set of components (speech corpus) and associate the components of the waveform with the data of a kind of voice indicated by the waveform (e.g., kind of phoneme) (labeling the components). When synthesizing the voice, the components are searched and concatenated to acquire the intended voice. The corpus base method is superior to the rule base method in the respect of quality of voice, and provides the correct sounds of the human voice.

To synthesize the natural voice by the corpus base method, it is required that the voice corpus contain a number of voice components. However, a voice corpus containing a greater number of components requires much labor of construction. Thus, a method for constructing the voice corpus efficiently is perceived in which the labeling of waveform components is automatically performed based on the result of voice recognition (e.g., refer to Patent Document 1).

[Patent Document 1]

Japanese Patent Application Laid-Open No. 6-266389

SUMMARY OF THE INVENTION

However, with the automatic labeling method based on the result of voice recognition, a labeling error is still likely to occur, though various improvements have been made. To make the natural speech synthesis, it is required to correct the labeling error. Conventionally, the verification of labeling error has been manually made, which causes much labor. Therefore, even if the labeling was automatically performed, the voice corpus with accurate labeling was not necessarily constructed easily.

This invention has been achieved in the light of the above-mentioned problems, and it is an object of the invention to provide a voice labeling error detecting system, a voice labeling error detecting method and a program for automatically detecting an error in labeling the data representing the voice.

In order to accomplish the above object, according to a first aspect of the invention, there is provided a voice labeling error detecting system including:

data acquisition means for acquiring the waveform data representing a waveform of a unit voice and the labeling data for identifying the kind of the unit voice;

classification means for classifying the waveform data acquired by the data acquisition means into the kinds of unit voice, based on the labeling data acquired by the data acquisition means;

evaluation value decision means for specifying a frequency of a formant of each unit voice represented by the waveform data acquired by the data acquisition means and determining an evaluation value of the waveform data based on the specified frequency; and error detection means for detecting the waveform data, from among a set of waveform data classified into the same kind, for which a deviation of evaluation value within the set reaches a predetermined amount, and outputting the data representing the detected waveform data, as waveform data having a labeling error.

The evaluation value may be a linear combination of the values $\{|f(k)-F(k)|\}$ where the value of k is an integer from 1 to n, assuming that F(k) is the frequency of the k-th formant of a unit voice indicated by the waveform data to calculate the evaluation value, and f(k) is the average value of the frequency of the k-th formant of the unit voice indicated by the waveform data classified into the same kind as the waveform data.

Or the evaluation value may be a linear combination of plural frequencies of formants in the spectrum of acquired waveform data.

The evaluation value deciding means may deal with the frequency at the maximal value of the spectrum in the waveform data as the frequency of formant of unit voice indicated by the waveform data.

The evaluation value deciding means may specify the order of formant used to decide the evaluation value of the waveform data as the kind of unit voice indicated by the waveform data, corresponding to the kind of labeling data.

The error detection means may detect the waveform data associated with the labeling data indicating a voiceless state at which the magnitude of voice represented by the waveform data reaches a predetermined amount as the waveform data in which the labeling has an error.

The classification means may comprise means for concatenating each waveform data classified into the same kind in the form in which two adjacent pieces of waveform data sandwiches data indicating the voiceless state therebetween.

According to a second aspect of the invention, there is provided a voice labeling error detecting method including the steps of:

acquiring the waveform data representing a waveform of a unit voice and the labeling data for identifying the kind of the unit voice;

classifying the acquired waveform data into the kinds of unit voice, based on the acquired labeling data;

specifying a frequency of a formant of each unit voice represented by the waveform data and deciding an evaluation value of the waveform data based on the specified frequency; and detecting the waveform data having a labeling error, from among a set of waveform data classified into the same kind, in which a deviation of evaluation value within the set reaches a predetermined amount and outputting data representing the detected waveform data.

According to a third aspect of the invention, there is provided a program for enabling a computer to operate as:

data acquisition means for acquiring the waveform data representing a waveform of a unit voice and the labeling data for identifying the kind of the unit voice;

classification means for classifying the waveform data acquired by the data acquisition means into the kinds of unit voice, based on the labeling data acquired by the data acquisition means;

evaluation value decision means for specifying a frequency of a formant of each unit voice represented by the waveform data acquired by the data acquisition means and deciding an evaluation value of the waveform data based on the specified frequency; and error detection means for detecting the waveform data having a labeling error, from among a set of waveform data classified into the same kind, in which a deviation of evaluation value within said set reaches a predetermined amount, and outputting the data representing the detected waveform data.

This invention provides a voice labeling error detecting system, a voice labeling error detecting method and a program for automatically detecting an error in labeling the data representing the voice.

DESCRIPTION OF THE PREFERRED EMBODIMENTS

The preferred embodiments of the present invention will be described below with reference to the accompanying drawings in connection with a voice labeling system as an example.

Figure 1:
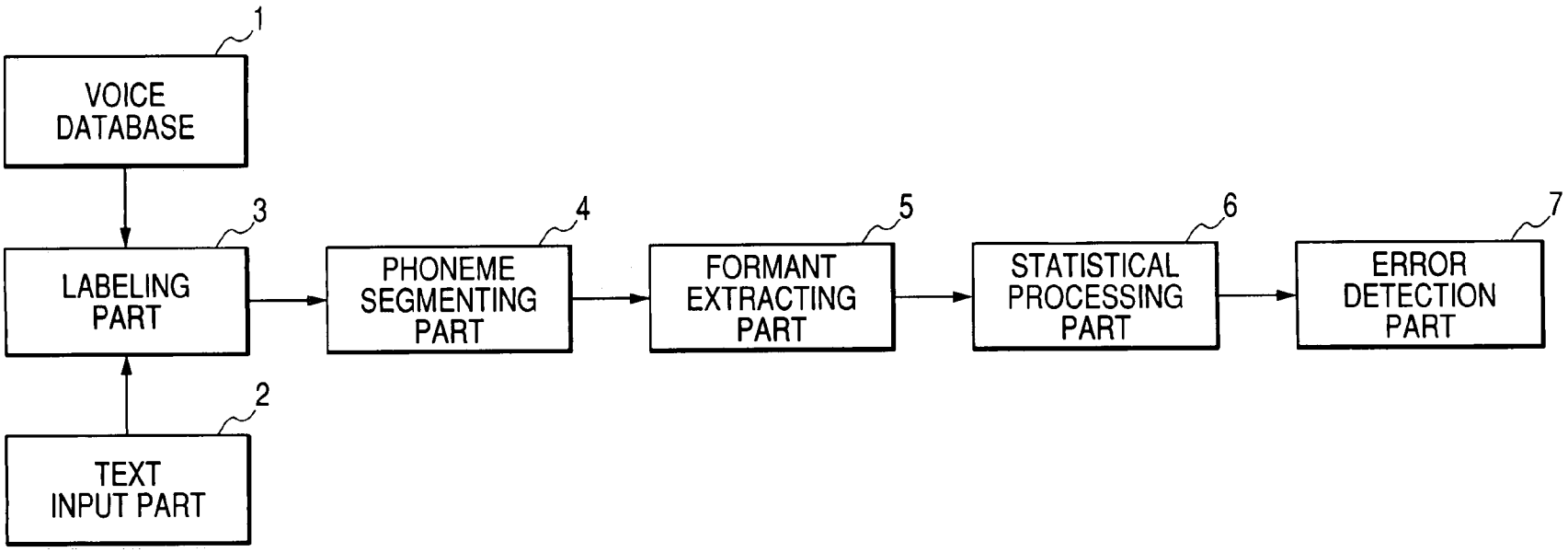
FIG. 1 is a block diagram showing a voice labeling system according to an embodiment of the invention.

FIG. 1 is a block diagram showing a voice labeling system according to an embodiment of the invention. As shown in FIG. 1, this voice labeling system comprises a voice database 1, a text input part 2, a labeling part 3, a phoneme segmenting part 4, a formant extracting part 5, a statistical processing part 6, and an error detection part 7.

The voice database 1 is constructed in a storage device such as a hard disk unit to store a large amount of voice data representing a waveform of a series of voice uttered by the same talker upon a user's operation and an acoustic model with the data indicating general features (e.g., height of voice) of voice uttered by the talker making voice upon a user's operation. It is necessary that the voice data has the form of a digital signal modulated in PCM (Pulse Code Modulation), for example. The voice data represents the voice sampled at a definite period sufficiently shorter than the pitch of voice.

A set of voice data stored in the voice database 1 functions as a voice corpus in the speech synthesis of the corpus base method. The voice data belonging to this set is directly employed as a component, for example, when one piece of voice data is totally employed as a waveform component of speech synthesis, or in other cases, the phonemic data into which the labeling part 3 partitions the voice data is employed as the component.

The text input part 2 is a recording medium drive unit (e.g., a floppy (registered trademark) disk drive or a CD drive) for reading data recorded in a recording medium (e.g., floppy (registered trademark) or CD (Compact Disk)), for example. The text input part 2 inputs the character string data representing a character string, and supplies it to the labeling part 3. The data format of character string data is arbitrary, and may be a text format. This character string indicates the kind of voice indicated by the voice data stored in the voice database 1.

The labeling part 3, the phoneme segmenting part 4, the formant extracting part 5, the statistical processing part 6 and the error detection part 7 are constituted of a processor such as a CPU (Central Processing Unit) or a DSP (Digital Signal Processor) and a memory such as a RAM (Random Access Memory) or a hard disk unit. The same processor may perform a part or all of the labeling part 3, the phoneme segmenting part 4, the formant extracting part 5, the statistical processing part 6 and the error detection part 7.

The labeling part 3 analyzes a character string indicated by the character string data supplied from the text input part 2, specifies each phoneme making up the voice represented by this character string data, and the prosody of voice, and produces a row of phoneme labels that is data indicating the kind of specified phoneme and a row of prosody labels that is data indicating the specified prosody.

Figure 2A:
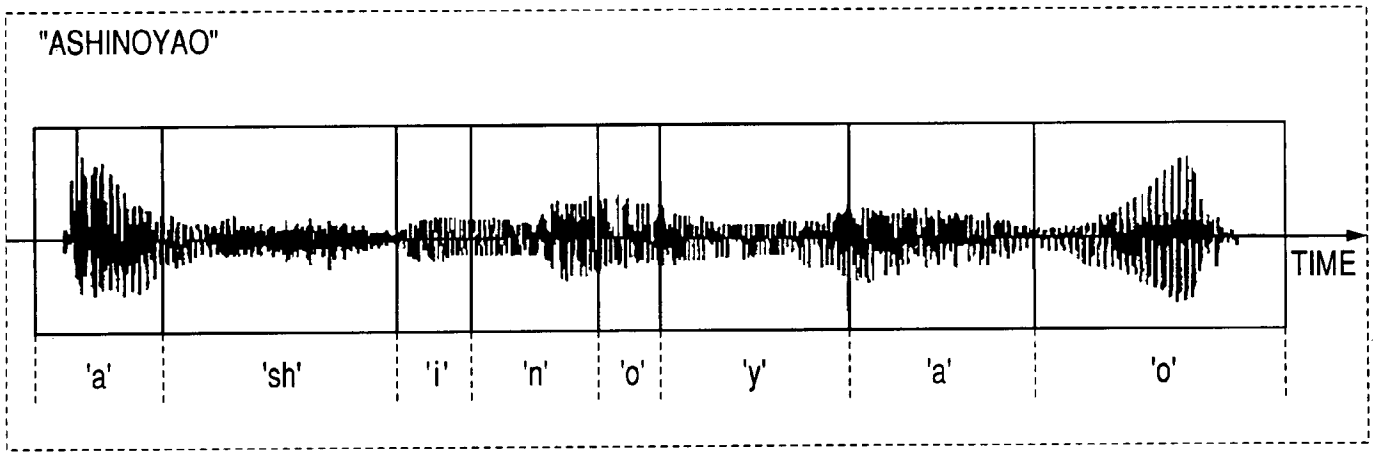
FIGS. 2A and 2B are charts schematically showing voice data in a partitioned state.
Figure 2B:
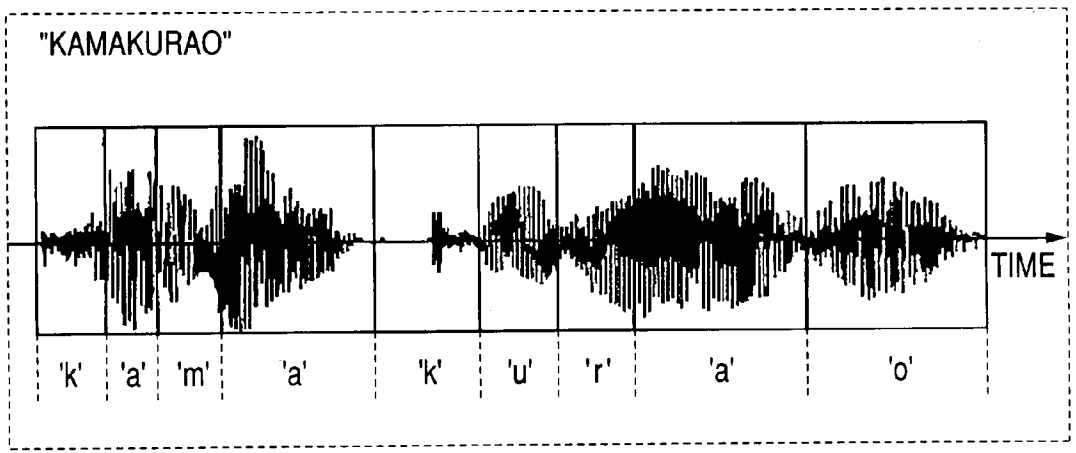

For example, it is supposed that the voice database 1 stores the first voice data representing the sounds of voice reading "ashinoyao", and the first voice data has a waveform as shown in FIG. 2A. Also, it is supposed that the voice database 1 stores the second voice data representing the sounds of voice reading "kamakurao", and the second voice data has a waveform as shown in FIG. 2B. On the other hand, it is supposed that the text input part 2 inputs data representing the character string "ashinoyao" as the first character string data indicating the reading of the first voice data, and inputs data representing the character string "kamakurao" as the second character string data indicating the reading of the second voice data, the input data being supplied to the labeling part 3. In this case, the labeling part 3 analyzes the first character string data to generate a row of phoneme labels indicating each phoneme arranged in the sequence of 'a', 'sh', 'i', 'n', 'o', 'y', 'a' and 'o', and generate a row of prosody labels indicating the prosody of each phoneme. Also, the labeling part 3 analyzes the second character string data to generate a row of phoneme labels indicating each phoneme arranged in the sequence of 'k', 'a', 'm', 'a', 'k', 'u', 'r', 'a' and 'o', and generate a row of prosody labels indicating the prosody of each phoneme.

Also, the labeling part 3 partitions the voice data stored in the voice database 1 into data (phonemic data) representing individual phonemic waveform. For example, the first voice data representing "ashinoyao" is partitioned into eight pieces of phonemic data indicating the waveforms of phonemes 'a', 'sh', 'i', 'n', 'o', 'y', 'a' and 'o' in the sequence from the top, as shown in FIG. 2A. Also, the second voice data representing "kamakurao" is partitioned into nine pieces of phonemic data indicating the waveforms of phonemes 'k', 'a', 'm', 'a', 'k', 'u', 'r', 'a' and 'o' in the sequence from the top, as shown in FIG. 2B. The partitioning position may be decided based on the phoneme labels produced per se and the acoustic model stored in the voice database 1.

The labeling part 3 assigns a phoneme label indicating no voice to a portion that is specified to become a voiceless state as a result of analyzing the character string data. Also, when the voice data contains a continuous interval indicating the voiceless state, the portion is partitioned as an interval to be associated with one phoneme label, like a portion indicating the phoneme.

And the labeling part 3 stores, for each phonemic data obtained, the phoneme label indicating the phoneme of the phonemic data and the prosody label indicating the prosody of phoneme in association with the phonemic data in the voice database 1. That is, the phonemic data is labeled by the phoneme label and the prosody label, whereby the phoneme indicating the phonemic data and the prosody of this phoneme can be made identified by the phoneme label and the prosody label.

More specifically, the labeling part 3 makes the voice database 1 store a row of phoneme labels and a row of prosody labels that have been obtained by analyzing the first character string data, in association with the first voice data partitioned into eight pieces of phonemic data. Also, the labeling part 3 makes the voice database 1 store a row of phoneme labels and a row of prosody labels that have been obtained by analyzing the second character string data, in association with the second voice data partitioned into nine pieces of phonemic data. In this case, the row of phoneme labels and the row of prosody labels associated with the first (or second) voice data represent the phonemes and its sequence of arrangement indicated by the phonemic data within the first (or second) voice data. In this manner, the k-th (k is a positive integer) phonemic data from the top of the first (or second) voice data is labeled by the k-th phoneme label from the top of the row of phoneme labels associated with this voice data and the k-th prosody label from the top of the row of prosody labels associated with this voice data. That is, the phoneme and the prosody of this phoneme indicated by the k-th (k is a positive integer) phonemic data from the top of the first (or second) voice data are identified by the k-th phoneme label from the top of the row of phoneme labels associated with this voice data and the k-th prosody label from the top of the row of prosody labels associated with this voice data.

The phoneme segmenting part 4 creates data (voice data for each phoneme) corresponding to the phonemic data connected according to the same phoneme as many as the number of kinds of phonemes indicated by each piece of phonemic data, employing each piece of phonemic data for which the labeling of phoneme label and prosody label has been completed, and supplies data to the formant extracting part 5.

For example, when the voice data for each phoneme is produced employing the first and second voice data having the waveforms as shown in FIGS. 2A and 2B, the voice data for each phoneme consisting of a total of ten pieces of data is created, including data corresponding to a connection of five waveforms of phoneme 'a', data corresponding to a connection of three waveforms of phoneme 'o', data corresponding to a connection of two waveforms of phoneme 'k', data corresponding to a waveform of phoneme 'sh', data corresponding to a waveform of phoneme 'i', data corresponding to a waveform of phoneme 'n', data corresponding to a waveform of phoneme 'y', data corresponding to a waveform of phoneme 'm', data corresponding to a waveform of phoneme 'u', and data corresponding to a waveform of phoneme 'r'.

Figure 3A:
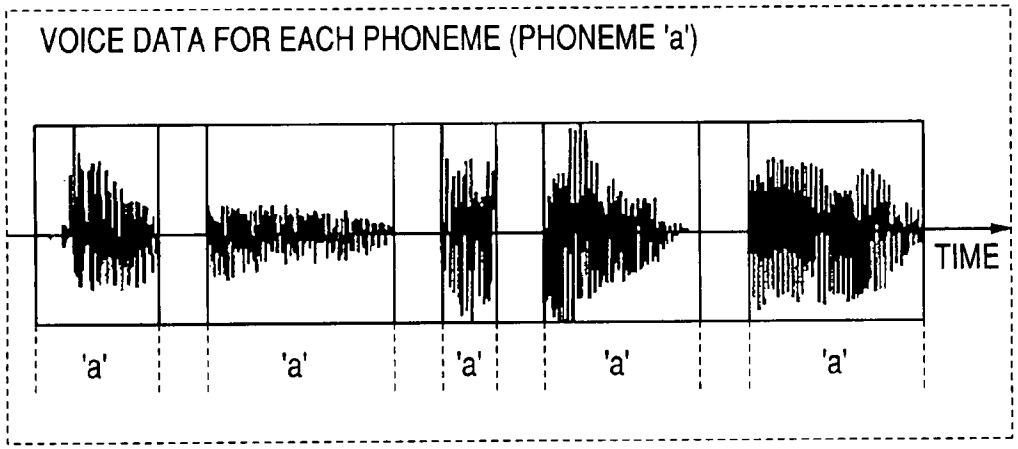
FIGS. 3A, 3B and 3C are charts schematically showing a data structure of the voice data for each phoneme containing plural phonemic data.
Figure 3B:
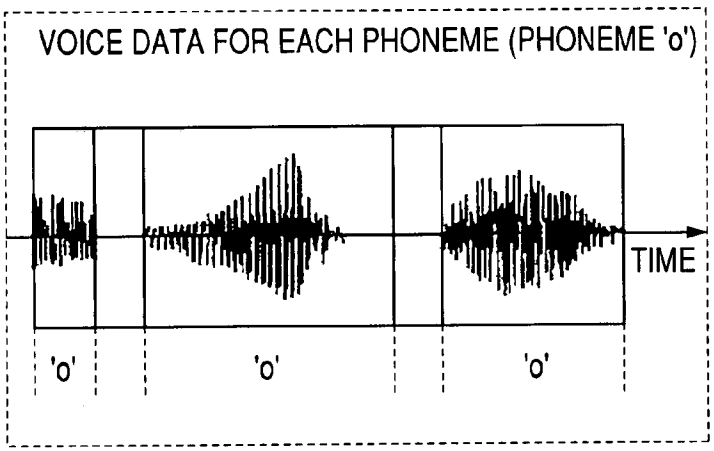
Figure 3C:
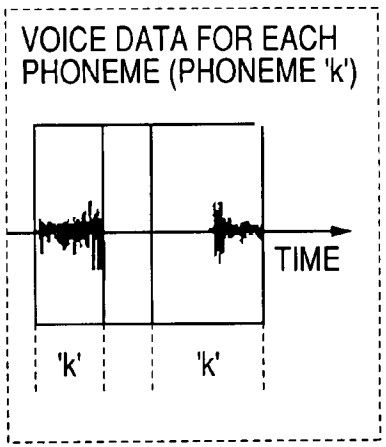

It is supposed that within the voice data for each phoneme containing a plurality of phonemic data, two pieces of phonemic data to be connected with each other are connected with each other with the voice data indicating the voiceless state for a definite time sandwiched therebetween. That is, when the voice data for each phoneme is produced employing the first and second voice data having the waveforms as shown in FIGS. 2A and 2B, for example, the voice data for each phoneme representing five waveforms of phoneme 'a', the voice data for each phoneme representing three waveforms of phoneme 'o' and the voice data for each phoneme representing two waveforms of phoneme 'k' have the waveforms in sequence as shown in FIGS. 3A, 3B and 3C.

Also, the phoneme segmenting part 4 creates data indicating the position and the voice data stored in the voice database 1 where each pieces of phonemic data contained in the voice data for each phoneme resides, and supplies the data to the formant extracting part 5.

The formant extracting part 5 specifies, for the voice data for each phoneme supplied by the phoneme segmenting part 4, the frequency of formant of phoneme represented by the phonemic data contained in the voice data for each phoneme, and notifies it to the statistical processing part 6.

The formant of phoneme is a frequency component at a peak of spectrum of phoneme caused by a pitch component (fundamental frequency component) of phoneme, in which a harmonic component that is k-times (k is an integer of 2 or greater) the pitch component is the (k-1)-th formant ((k-1)-order formant). Accordingly, the formant extracting part 5 may specifically calculate the spectra of phonemic data by the fast Fourier transform method (or any other methods for producing data resulted from the Fourier transform of discrete variable), and specify and notify the frequency giving the maximal value of this spectrum as the frequency of formant.

It is assumed that the minimum order of formant to specify the frequency is 1, and the maximum order is preset for each phoneme (identified by the phoneme label). The maximum order of formant to specify the frequency for each phonemic data is arbitrary, but may be about three when the phoneme identified by the phoneme label is vowel, and be about five to six when it is consonant, to obtain the good results.

When the phoneme is fricative, the pitch component or the components caused by it are not contained by a large amount in the spectrum, but more components with high frequency and less regularity are contained in the spectrum, whereby the formant is difficult to specify. However, in this case, the formant extracting part 5 regards the component forming the peak appearing in the spectrum of phoneme as the formant. By treating in this manner, this voice labeling system can detect a labeling error for the fricative sufficiently and correctly.

For the voice data for each phoneme consisting of phonemic data indicating the voiceless state, the formant extracting part 5 specifies the magnitude of voice indicated by the phonemic data (phonemic data indicating the voiceless state) contained in the voice data for each phoneme, instead of specifying the frequency of formant of the phonemic data, and notifies it to the error detection part 7. More specifically, for example, the voice data for each phoneme is filtered to remove substantially the band other than the band in which the voice spectrum is usually contained, the phonemic data contained in the voice data for each phoneme is subjected to the Fourier transform, and the sum of strength (or absolute value of sound pressure) of each spectrum component obtained is specified, as the magnitude of voice indicated by the phonemic data, and notified to the error detection part 7.

The statistical processing part 6 calculates the evaluation value H as shown in Formula 1 for each phonemic data based on the frequency of formant notified from the formant extracting part 5, where F(k) is the frequency of the k-th formant of phoneme indicated by the phonemic data to calculate the evaluation value H, f(k) is the average value of F(k) value obtained from all the phonemic data indicating the same kind of phonemic as the phonemic of interest (i.e., all the phonemic data contained in the voice data for each phoneme to which the phonemic data to calculate the evaluation value H belongs), W(1) to W(n) are weighting factors, and n is the order of formant of the phoneme having the highest frequency among the frequencies for use to calculate the evaluation value H. That is, the evaluation value H is a linear combination of the values $\{|f(k)-F(k)|\}$ where the value of k is an integer from 1 to n.

$$H = \sum_{k=1}^{n} \{|f(k) - F(k)| \cdot W(k)\} \quad \text{(Formula 1)}$$

And the statistical processing part 6 calculates a deviation from the average value within a population for each evaluation value H within the population, where the population is a set of evaluation values H for each phonemic data indicating the same kind of phoneme, for example. The statistical processing part 6 makes this operation for calculating the deviation of the evaluation value H for the phonemic data indicating all the kinds of phonemes. And the statistical processing part 6 notifies the evaluation values H and their deviations for all the pieces of phonemic data to the error detection part 7.

If the evaluation value H for each phonemic data and its deviation are notified from the statistical processing part 6, the error detection part 7 specifies the phonemic data in which the deviation of the evaluation value H reaches a predetermined amount H (e.g., the standard deviation of evaluation value H), based on the notified contents. And data indicating that the specified phonemic data has a labeling error (i.e., labeling is made with the phoneme label indicating the phoneme different from the phoneme indicated by the actual waveform) is produced and outputted to the outside.

The error detection part 7 specifies the phonemic data indicating the voiceless state in which the magnitude of voice notified from the formant extracting part 5 reaches a predetermined amount, and produces the data indicating that the specified phonemic data in voiceless state has a labeling error (i.e., labeling is made with the phoneme label indicating the voiceless state, though the actual waveform is not the voiceless state) to be outputted to the outside.

By performing the above operation, this voice labeling system automatically determines whether or not the labeling of the voice data made by the labeling part 3 has an error, and notifies to the outside that there is an error, if any. Therefore, a manual operation of checking whether or not the labeling has an error is omitted, and the voice corpus having a large amount of data can be easily constructed.

The configuration of this voice labeling system is not limited to the above.

For example, the text input part 2 may comprise an interface part such as a USB (Universal Serial Bus) interface circuit or a LAN (Local Area Network) interface circuit, in which the character string data is acquired from the outside via this interface part and supplied to the labeling part 3.

Also, the voice database 1 may comprise a recording medium drive unit, in which the voice data recorded in the recording medium is read via the recording medium drive unit and stored. Also, the voice database 1 may comprise an interface part such as USB interface circuit or LAN interface circuit, in which the voice data is acquired from the outside via this interface part and stored. Also, the recording medium drive unit or interface part constituting the text input part 2 may also function as the recording medium drive unit or interface part of the voice database 1.

Also, the phoneme segmenting part 4 may comprises a recording medium drive unit, in which the labeled voice data recorded in the recording medium is read via the recording medium drive unit, and employed to produce the voice data for each phoneme. Also, the phoneme segmenting part 4 may comprise an interface part such as USB interface circuit or LAN interface circuit, in which the labeled voice data is acquired from the outside via this interface part and employed to produce the voice data for each phoneme. Also, the recording medium drive unit or interface part constituting the voice database 1 or text input part 2 may also function as the recording medium drive unit or interface part of the phoneme segmenting part 4.

Also, the labeling part 3 does not necessarily segment the voice data for each phoneme, but may segment it in accordance with any criterion allowing for the labeling with the phonetic symbol or prosodic symbol. Accordingly, the voice data may be segmented for each word or each unit mora.

Also, the phoneme segmenting part 4 does not necessarily produce the voice data for each phoneme. Also, when the voice data for each phoneme is produced, it is not always necessary to insert the waveform indicating the voiceless state between two adjacent pieces of phonemic data within the voice data for each phoneme. When the waveform indicating the voiceless state is inserted between the pieces of phonemic data, there is an advantage that the position of the boundary between the pieces of phonemic data within the voice data for each phoneme is clarified, and can be identified by reproducing the voice represented by the voice data for each phoneme for the listener to listen to it.

The formant extracting part 5 may make a cepstrum analysis to specify the value of frequency of the formant in the voice data. As a specific processing of the cepstrum analysis, the formant extracting part 5 converts the strength of waveform indicated by the phonemic data to the value substantially equivalent to the logarithm of original value, for example. (The base of logarithm is arbitrary, and common logarithm may be used, for example.) And the spectrum (i.e., cepstrum) of phonemic data with the converted value is acquired by the fast Fourier transform (or any other methods for producing the data resulted from the Fourier transform for the discrete variable.) And the frequency at the maximal value of cepstrum is specified as the frequency of formant for this phonemic data.

Also, the above value of f(k) is not necessarily the average value of F(k) value, but may be the median or mode of F(k) value obtained from all the phonemic data contained in the voice data for each phoneme to which the phonemic data to calculate the evaluation value H belong, for example.

Also, the statistical processing part 6 may calculate the evaluation value h as shown in Formula 2 for each phonemic data, instead of calculating the evaluation value H as represented by Formula 1, in which the error detection part 7 deals with the evaluation value h like the evaluation value H, where F(k) is the frequency of the k-th formant of phoneme indicated by the phonemic data to calculate the evaluation value h, w(1) to w(n) are weighting factors, and n is the order of formant of the phoneme having the highest frequency among the frequencies for use to calculate the evaluation value h. That is, the evaluation value h is a linear combination of plural frequencies of the first to n-th formants for the phonemic data.

$$h = \sum_{k=1}^{n} \{f(k) \cdot w(k)\} \quad \text{(Formula 2)}$$

Though the embodiment of the invention has been described above, the voice labeling error detecting system according to this invention may be realized not only by the dedicated system, but also by an ordinary personal computer. For example, the voice labeling system may be implemented by installing a program from the storage medium (CD, MO, floppy® disk and so on) storing the program that enables the personal computer to perform the operations of the voice database 1, the text input part 2, the labeling part 3, the phoneme segmenting part 4, the formant extracting part 5, the statistical processing part 6 and the error detection part 7.

Figure 4:
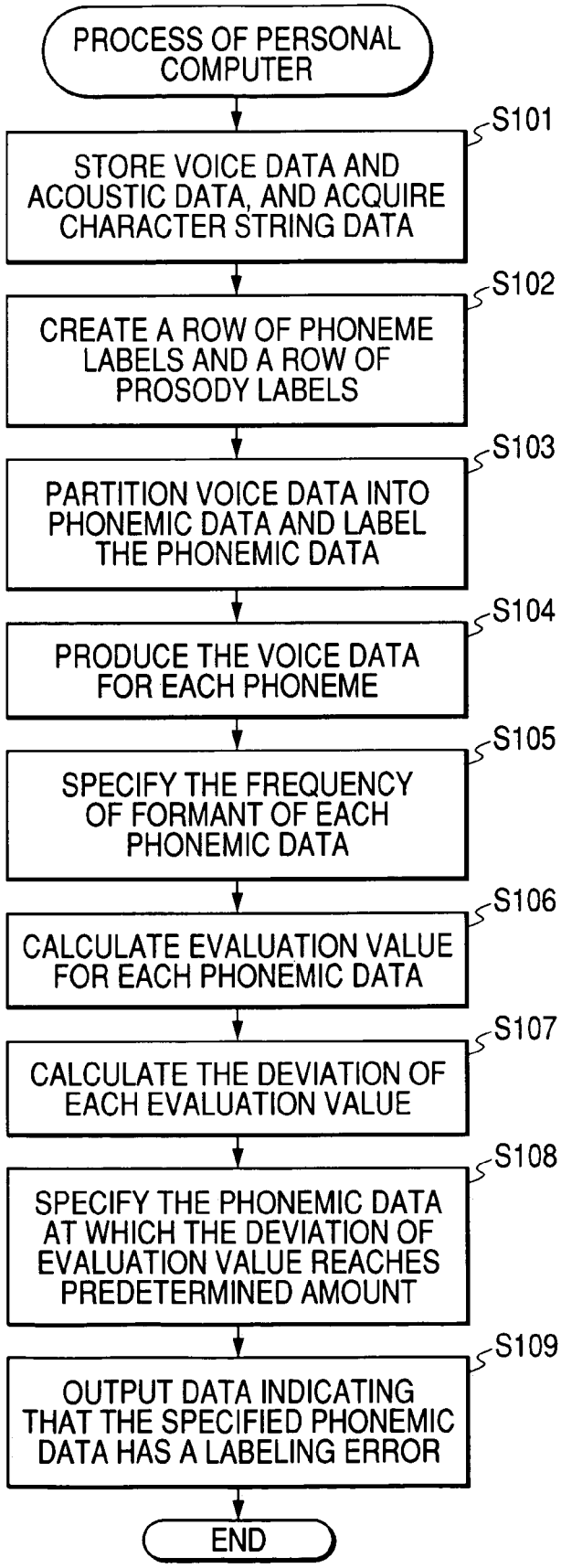
FIG. 4 is a flowchart showing a procedure that is performed by a personal computer having a function of voice labeling system according to the embodiment of this invention.

And the personal computer executing this program performs a procedure as shown in FIG. 4 as the process corresponding to the operation of the voice labeling system of FIG. 1. FIG. 4 is a flowchart showing the process performed by the personal computer.

That is, the personal computer stores the voice data and the acoustic data to make the voice corpus and reads the character string data recorded on the recording medium (FIG. 4, step S101). Then, the character string indicated by this character string data is analyzed to specify each phoneme making up the voice represented by the character string data and the prosody of this voice, and a row of phoneme labels and a row of prosody labels as the data indicating the specified prosody are produced (step S102).

And this personal computer partitions the voice data stored at step S101 into phonemic data, and labels the obtained phonemic data with the phoneme label and prosody label (step S103).

Then, this personal computer produces the voice data for each phoneme, employing each piece of phonemic data for which the labeling with the phoneme label and prosody label has been completed (step S104), and specifies, for the voice data for each phoneme, the frequency of formant of phoneme indicated by the phonemic data contained in the voice data for each phoneme (step S105). However, at step S105, this personal computer specifies the magnitude of voice indicated by the phonemic data indicating the voiceless state, instead of specifying the frequency of formant of phonemic data, for the voice data for each phoneme composed of the phonemic data indicating the voiceless state.

Then, this personal computer calculates the above evaluation value H or evaluation value h for each piece of phonemic data, based on the frequency of formant specified at step S105 (step S106). For example, the personal computer calculates a deviation from the average value (or median or mode) within a population for each evaluation value H (or evaluation value h) within the population, where the population is a set of evaluation values H (or evaluation values h) for each phonemic data indicating the same kind of phoneme (step S107), and specifies the phonemic data at which the obtained deviation reaches a predetermined amount (step S108). And data indicating that the labeling of specified phonemic data has an error is produced and outputted to the outside (step S109). At step S109, the personal computer specifies the phonemic data indicating the voiceless state at which the magnitude of voice obtained at step S105 reaches a predetermined amount, produces data indicating that the labeling of specified phonemic data in the voiceless state has an error, and outputs it to the outside.

The program enabling the personal computer to perform the functions of the voice labeling system may be uploaded to a bulletin board (BBS) on the communication line, and distributed via the communication line. Also, the program may be obtained by modulating the carrier with a signal representing the program, and transmitting the modulated wave, in which the apparatus receiving the modulated wave demodulates this modulated wave to restore the program. And this program is initiated and executed under the control of an OS, like other application programs, to perform the above processes.

When the OS takes charge of a part of the process, or when the OS constitutes a part of the component of this invention, the recording medium stores the program except for that part. In this case, the recording medium stores the program for performing the functions or steps executed by the computer in this invention.

What is claimed is:

1. A voice labeling error detecting system comprising:

data acquisition means for acquiring waveform data representing a waveform of a unit voice and labeling data for identifying a kind of said unit voice;

classification means for classifying the waveform data acquired by said data acquisition means into the kinds of unit voice, based on the labeling data acquired by said data acquisition means;

evaluation value decision means for specifying a frequency of a formant of each unit voice represented by the waveform data acquired by said data acquisition means and determining an evaluation value of said waveform data based on the specified frequency; and error detection means for detecting the waveform data from among a set of waveform data classified into a same kind, for which a deviation of evaluation value within said set reaches a predetermined amount, and outputting the data representing said detected waveform data, as waveform data having a labeling error, and wherein said evaluation value H is calculated by the following formula representing a linear combination of values $\{|f(k)-F(k)|\}$:

$$H = \sum_{k=1}^{n} \{|f(k) - F(k)| \cdot W(k)\}$$

wherein F(k) is a frequency of the k-th formant of a unit voice indicated by the waveform data to calculate the evaluation value, and f(k) is an average value of the frequency of the k-th formant of the unit voice indicated by each waveform data classified into the same kind as said waveform data, W(k) is a weighting factor and n is the order of formant of the phoneme having the highest frequency.

2. The voice labeling error detecting system according to claim 1, characterized in that said evaluation value is a linear combination of plural frequencies of formants in a spectrum of acquired waveform data.

3. The voice labeling error detecting system according to claim 1 or 2, characterized in that said evaluation value deciding means deals with a frequency at a maximal value of a spectrum in the waveform data as the frequency of formant of unit voice indicated by said waveform data.

4. The voice labeling error detecting system according to any one of claim 1 or 2, characterized in that said evaluation value deciding means specifies an order of formant used to decide the evaluation value of the waveform data as the kind of unit voice indicated by said waveform data, corresponding to the kind of labeling data.

5. The voice labeling error detecting system according to any one of claim 1 or 2, characterized in that said error detection means detects the waveform data associated with the labeling data indicating a voiceless state at which a magnitude of voice represented by said waveform data reaches a predetermined amount as the waveform data in which the labeling has an error.

6. The voice labeling error detecting system according to claim 1 or 2, characterized in that said classification means comprises means for concatenating each waveform data classified into the same kind in the form in which two adjacent pieces of waveform data sandwiches data indicating a voiceless state therebetween.

7. A voice labeling error detecting method comprising the steps of:

acquiring waveform data representing a waveform of a unit voice and labeling data for identifying a kind of said unit voice;

classifying said acquired waveform data into the kinds of unit voice, based on said acquired labeling data;

specifying a frequency of a formant of each unit voice represented by the waveform data and deciding an evaluation value of said waveform data based on the specified frequency; and detecting the waveform data having a labeling error, from among a set of waveform data classified into a same kind, in which a deviation of evaluation value within said set reaches a predetermined amount and outputting data representing said detected waveform data, wherein said evaluation value H is calculated by the following formula representing a linear combination of values $\{|f(k)-F(k)|\}$:

$$H = \sum_{k=1}^{n} \{|f(k) - F(k)| \cdot W(k)\}$$

wherein F(k) is a frequency of the k-th formant of a unit voice indicated by the waveform data to calculate the evaluation value, and f(k) is an average value of the frequency of the k-th formant of the unit voice indicated by each waveform data classified into the same kind as said waveform data, W(k) is a weighting factor and n is the order of formant of the phoneme having the highest frequency.

* * * * *